US011511460B2

(12) United States Patent
Del Zotto

(10) Patent No.: US 11,511,460 B2
(45) **Date of Patent: *Nov. 29, 2022**

(54) DEVICES AND PROCESSES FOR MAKING CONCRETE ARTICLES

(71) Applicant: William M. Del Zotto, Gladewater, TX (US)

(72) Inventor: William M. Del Zotto, Gladewater, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/871,001

(22) Filed: May 10, 2020

(65) Prior Publication Data

US 2020/0269467 A1 Aug. 27, 2020

Related U.S. Application Data

(63) Continuation of application No. 16/516,372, filed on Jul. 19, 2019, now Pat. No. 10,703,013, which is a (Continued)

(51) Int. Cl.
*B28B 21/90* (2006.01)
*B28B 21/16* (2006.01)
(Continued)

(52) U.S. Cl.
CPC ..... *B28B 21/90* (2013.01); *B28B 5/04* (2013.01); *B28B 21/16* (2013.01); *B28B 21/82* (2013.01)

(58) Field of Classification Search
CPC ..... B28B 21/90; B28B 21/16; B28B 21/82; B28B 5/04
See application file for complete search history.

(56) References Cited

U.S. PATENT DOCUMENTS 2,926,411 A 3/1960 Steiro
3,107,946 A * 10/1963 Drake ..... F16C 27/063 384/222

(Continued)

*Primary Examiner* — Nahida Sultana
(74) *Attorney, Agent, or Firm* — Buss & Benefield PLLC; Michael A. Benefield

(57) ABSTRACT

Described are improved devices and processes for manufacturing concrete articles, including concrete pipe. In one embodiment, the invention provides an apparatus that has a first platform that is located beneath the floor of a manufacturing facility. The first platform includes a top surface and is configured to move bi-directionally along an axis. Two form bases can reside on the top surface of the first platform, each form base further including a form core that extends vertically from the first platform through respective holes in a second platform that resides above the first platform at an elevation even with or just above the floor's surface. The second platform is configured to move bi-directionally with the first platform between one of two cranes disposed on either side of a concrete mixer. A form is placed over the first core, which is then positioned under the outlet of an auger that receives concrete from the mixer. After filling is complete, the first core is positioned under the first crane which provides ballast to compress the concrete, and the second core (with a form) is placed under the auger's outlet for filling. After compression of the first form complete, the form can be removed using an overhead crane, and the second core is relocated to the second crane for concrete compression.

18 Claims, 6 Drawing Sheets

Related U.S. Application Data continuation of application No. 15/420,839, filed on Jan. 31, 2017, now Pat. No. 10,493,656.

(51) Int. Cl.
*B28B 21/82* (2006.01)
*B28B 5/04* (2006.01)

(56) References Cited

U.S. PATENT DOCUMENTS 3,274,659 A 9/1966 Baker
3,318,208 A * 5/1967 Durston ..... E02B 3/121 404/102
3,382,550 A * 5/1968 Smith ..... B28B 3/022 425/452
3,383,742 A * 5/1968 Nelson ..... B28B 21/90 425/452
3,485,383 A * 12/1969 Bedhun ..... B66C 23/36 212/195
3,577,610 A 5/1971 Margolin
3,584,356 A 6/1971 Joelson
3,632,270 A 1/1972 Baker et al.
RE28,902 E 7/1976 Frautner et al.
4,098,562 A * 7/1978 Levin ..... B28B 5/04 425/121
4,118,165 A 10/1978 Christian
4,197,074 A 4/1980 Christian
4,235,580 A 11/1980 Springs
4,290,740 A 9/1981 Borcoman
4,708,621 A 11/1987 Schmidgall et al.
4,756,861 A 7/1988 Schultz
5,147,196 A 9/1992 Adly
5,167,967 A 12/1992 Adly
5,234,331 A 8/1993 Schmidgall
5,533,885 A 7/1996 Schlusselbauer
5,648,108 A 7/1997 Hvidegaard
5,728,327 A * 3/1998 Borcoman ..... B28B 15/002 264/39
5,792,484 A 8/1998 Schmidgall
6,017,208 A 1/2000 Schultz
7,083,406 B2 8/2006 Stoller et al.
7,832,703 B2 11/2010 Schmidgall et al.
8,926,311 B1 1/2015 Schmidgall
2002/0017741 A1* 2/2002 Sumrall ..... B28B 5/04 425/453
2003/0205833 A1 11/2003 Schlusselbauer
2006/0169868 A1 8/2006 Anderson et al.
2012/0139163 A1 6/2012 Garfinkel et al.
2014/0377393 A1 12/2014 Karau
2015/0135636 A1* 5/2015 Ayres ..... B07B 15/00 52/745.03
2015/0165645 A1 6/2015 Easton et al.
2015/0284187 A1* 10/2015 Layne ..... B65G 21/12 198/851
2016/0236374 A1 8/2016 Subacchi

* cited by examiner

DEVICES AND PROCESSES FOR MAKING CONCRETE ARTICLES

CROSS-REFERENCE TO RELATED APPLICATIONS

This application is a continuation of U.S. patent application Ser. No. 16/516,372, filed Jul. 19, 2019, which is a continuation of U.S. patent application Ser. No. 15/420,839, filed Jan. 31, 2017, now U.S. Pat. No. 10,493,656, each of which is hereby incorporated herein by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

The inventor disclosed aspects of the inventions described herein to others as early as Aug. 1, 2016.

BACKGROUND OF THE INVENTION

1. Field of the Invention

The inventions described herein generally relate to devices and processes for the manufacture of pre-cast concrete articles.

2. Description of Related Art

U.S. Pat. No. 5,648,108 to Hvidegaard discloses a production system for automatically casting hollow concrete bodies, including concrete pipe. The disclosed pipe manufacturing process generally includes the placement of an inner mold onto a table that may be stationary or rise vertically during the casting process. Prior to casting, a bottom ring is placed over the inner mold and located on the table. An outer mold is then lowered over the inner mold such that it stands on the bottom ring, which then forms a mold part for the lower end of the pipe. Hvidegaard refers to the bottom end of the pipe as the socket end.

After the outer mold is placed on the bottom ring, fresh concrete is poured from above into the mold. If a vertically displaceable inner mold is used, it is simultaneously caused to rise (by moving the table) so as to successively define a ring gap between the outer and inner molds for forming the pipe wall. After pouring is complete, an upper ring or profile ring is pressed into the upper side of the concrete to form the spigot end of the pipe. After pressing is complete, the outer mold, along with the bottom and upper rings and the concrete, are stripped from the inner mold by moving the outer mold up (with the rings), in possible conjunction with moving the inner mold down. The mold and rings carrying the concrete are then relocated to an area where the concrete can cure. Although the outer mold is removed after relocation, Hvidegaard allows the bottom and upper rings to remain in place during curing in order to maintain the appropriate shapes for the respective ends of the pipe. More specifically, Hvidegaard discloses a machine that releasably secures the upper ring to the machine so that the upper ring may be released from the machine after pressing and remain on the spigot end of the pipe in order to properly maintain the shape of the spigot end during curing. After processing is complete, Hvidegaard's machine grips a new upper ring as it prepares to make the next article.

U.S. Pat. No. 4,708,621 to Schmidgall et al. discloses a machine for making concrete pipe. The disclosed machine has an upper part and a lower part. The lower part includes a circular turn table that is typically located beneath the floor and has three stations, each of which includes a module that incorporates an inner mold core. The upper part of the machine includes components to provide three stations used in the manufacture of concrete pipe: stripping, filling, and pressure-heading. The upper part of the machine also includes structural steel to support the pressure-heading station which includes a circular head that moves perpendicularly to the table via hydraulic mechanisms. The table is rotated to each of the three stations during pipe manufacturing to accommodate the process.

The process begins by placing an outer mold jacket with a removable pallet secured to its lower end over the inner core located at the stripping station. After the mold jacket is located over the inner core, the table is turned so that the mold jacket is positioned at the filling station, where fresh concrete is then added to the mold jacket so as to fill the space between the mold jacket and inner core. The inner mold core can be vibrated during the filling process to help fill the mold with concrete. After filling is complete, the table is again rotated so that the filled mold arrives at the pressure-heading station where the pressure head is lowered by hydraulics onto the top of the form to compact the concrete. Vibration is typically utilized in conjunction with pressure-heading and the pressure-head is typically equipped with a tongue-trowel which resolves the top joint during vibration to produce a smooth, trowel-finished joint. After pressure-heading is complete, the table is again rotated to the stripping station where the outer mold jacket (and concrete) is remove and relocated to another area for curing and a new outer mold is placed in preparation for filling. The disclosed stations can operate in simultaneous fashion, to speed up the production process.

U.S. Pat. No. 5,533,885 to Schlusselbauer discloses an apparatus and process for making concrete pipe. The apparatus includes a single mold core disposed in a pit and longitudinally adjacent to a stack of molding rings. A mold shell is lowered over the mold core using an overhead crane. After the mold shell is in place, the crane is relocated and a carriage is located over the pit. The carriage includes a mold press that is disposed over the stack of molding rings and a bin filled with concrete located over the mold. Beneath the bin is a conveyor belt that carries concrete to a turntable (located partially beneath the conveyor belt) that dispenses the concrete into the periphery of the mold. During the filling process, the ram of the mold press is lowered to the molding ring stack so it can retain a molding ring. After filling is complete, the carriage is moved such that the mold press is located over the mold. The mold press is then used to press the molding ring into the mold so as to compress the concrete. After pressing is complete, the carriage is displaced so that the overhead crane can remove the mold (and concrete) from the mold core and relocate it to permit the concrete to cure. The process may then repeated.

In view of the background in this area, there remain needs for improved and/or alternative devices and processes for making concrete articles. The present invention is addressed to those needs.

BRIEF SUMMARY OF THE INVENTION

In one aspect, the invention provides an apparatus for the manufacture of articles made of concrete that includes a first platform having a top surface and a bottom surface, where the first platform is configured to move bi-directionally along an axis. The apparatus also includes at least one form base that resides on the top surface of the first platform. The at least one form base is releasably secured to the first platform and is configured to releasably receive a form used in the manufacture of concrete articles.

In another aspect, the invention provides a process for manufacturing concrete articles. The process includes providing an apparatus for the manufacture of articles made of concrete that includes a first platform having a top surface and a bottom surface, where the first platform is configured to move bi-directionally along an axis. The apparatus also includes a first form base and a second form base that resides on the top surface of the first platform. The first form base and second form base are each releasably secured to the first platform and are each configured to releasably receive a form used in the manufacture of concrete articles. The first form base and the second form base each occupy a generally square shape, each form base having a center point located in the center of the square. The top surface of the first platform of the provided apparatus is located approximately 7.8 feet beneath the floor of a manufacturing facility. The provided apparatus also includes a second platform having a top surface and a bottom surface, where the top surface of the second platform is located at an elevation even with or above the top surface of the manufacturing floor. The second platform is configured to move bi-directionally with the first platform, and includes a first hole and a second hole, each having a center point that is respectively located above the center point of the first form base and the second form base. A first and second form core is respectively attached to the first and second form bases in a manner where the first and second form core extends vertically from the form bases and terminate at a location above the top surface of the second platform. The provided apparatus also includes a first crane and a second crane, each configured to deliver ballast above the respective first and second form cores. The provided apparatus also includes a concrete mixer located between the first and second cranes, the concrete mixer having an auger with its inlet disposed at a location close to the concrete mixer and its outlet locatable at a location over the top surface of the second platform. The process also includes placing a first form over the first form core; locating the first and second platforms so that the first form core is generally underneath the outlet of the auger; feeding concrete from the auger outlet into the space between the first form and the first form core; placing a second form over the second form core; locating the first and second platforms so that the second form core is generally underneath the auger outlet; compressing the concrete between the first form and the first form core with the first ballast attached to the first crane so as to form a concrete article that has an outer exterior shape of the first form and an inner exterior shape of the first form core; and removing the first form containing the concrete article from the first form core.

In yet another embodiment, the invention provides a concrete article manufactured in accordance with the process described in the preceding paragraph.

DETAILED DESCRIPTION OF THE INVENTION

For the purposes of promoting an understanding of the principles of the invention, reference will now be made to certain embodiments thereof and specific language will be used to describe the same. It will nevertheless be understood that no limitation of the scope of the invention is thereby intended, such alterations, further modifications and further applications of the principles of the invention as described herein being contemplated as would normally occur to one skilled in the art to which the invention relates.

Figure 1:
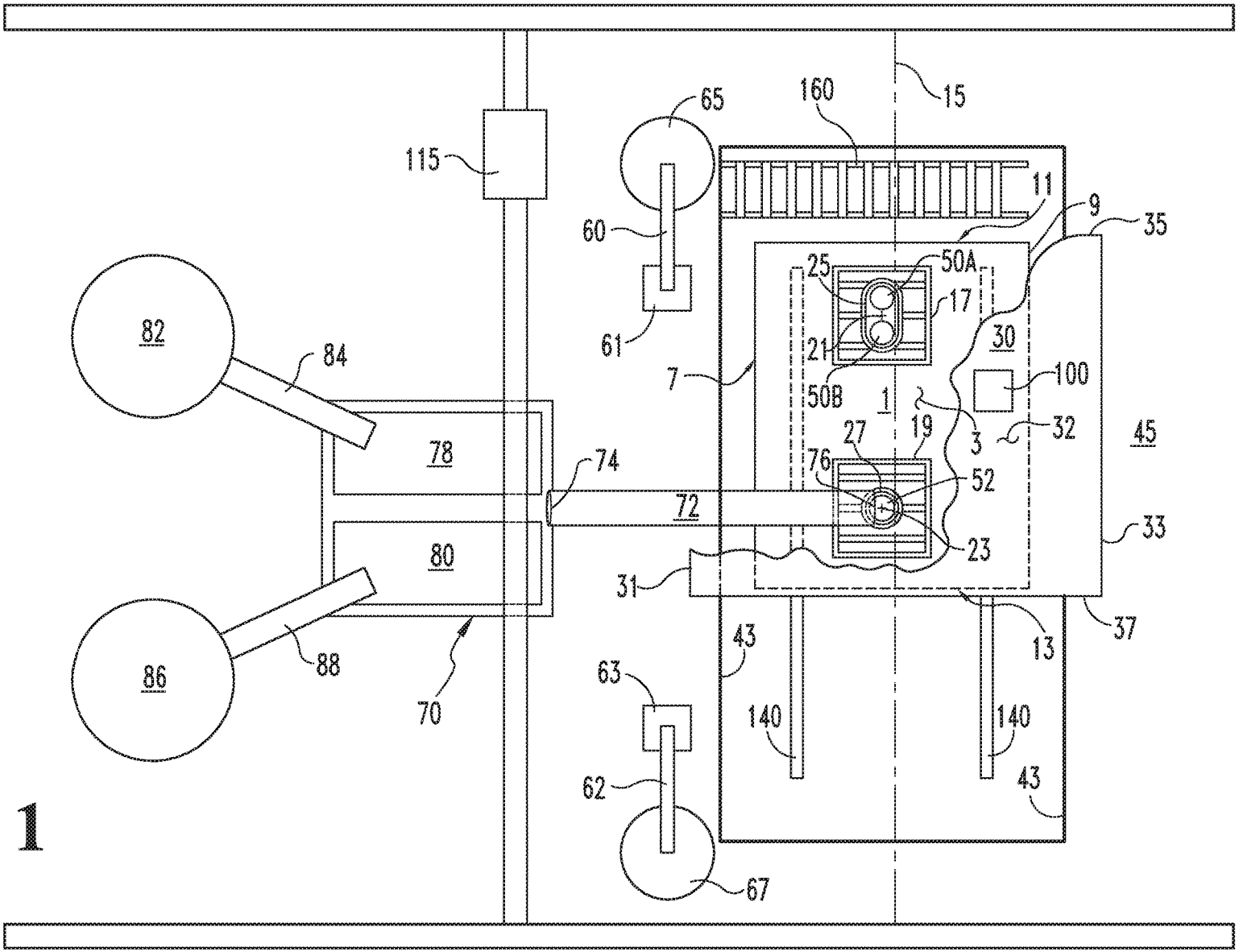
FIG. 1 provides a top plan view of an illustrative embodiment of the invention.
Figure 2:
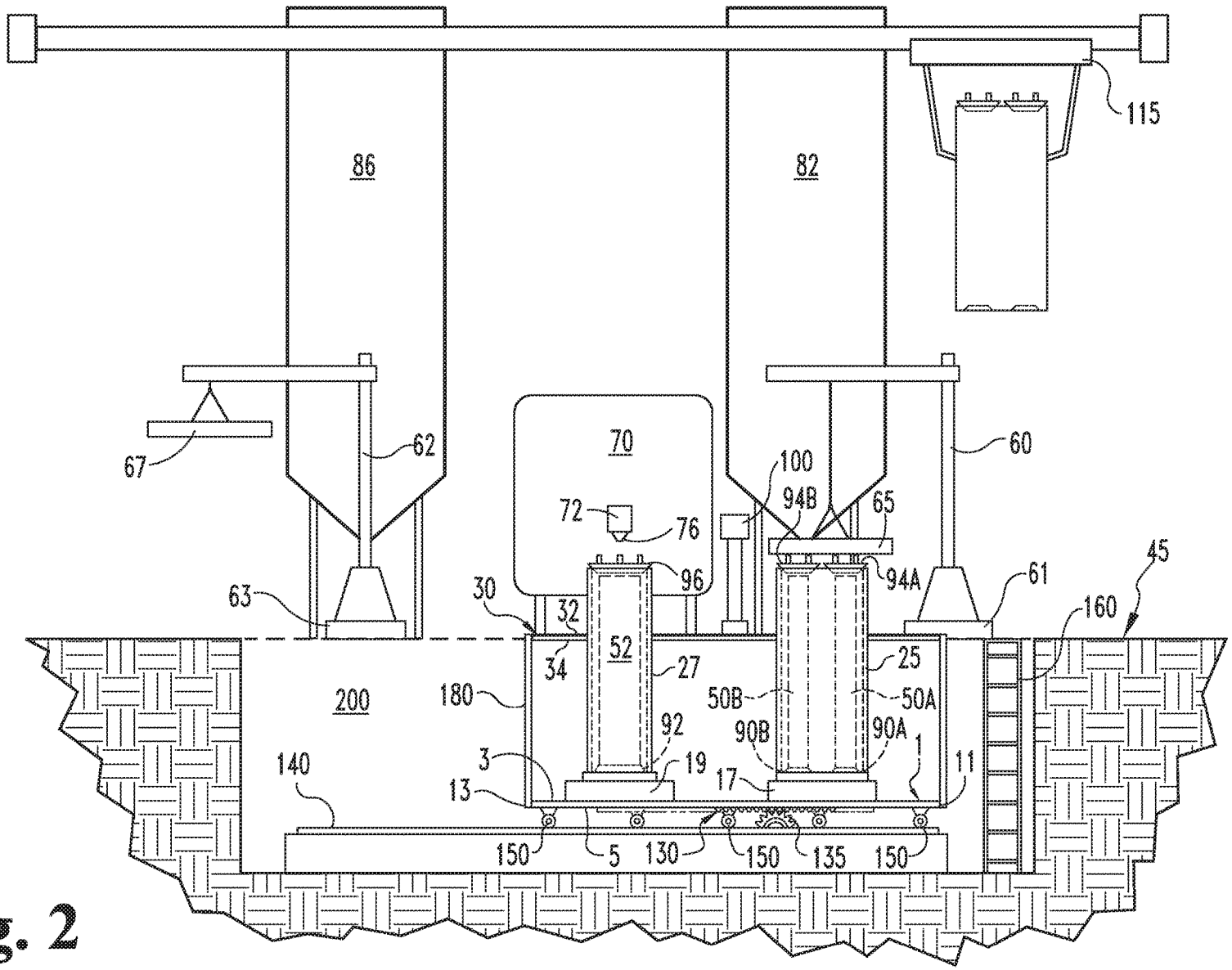
FIG. 2 provides a front elevation view of the illustrative embodiment depicted in FIG. 1.

The embodiment depicted in FIGS. 1-2 includes a first platform 1 having a top surface 3 that is located beneath the top surface of a floor in a manufacturing facility 45. The top surface 3 of the first platform 1 is bounded by first and second longitudinal sides 7, 9 and first and second crosswise sides 11, 13. The first platform 1 includes a bottom surface 5 that is generally co-extensive with the top surface 3. The first platform 1 can be made of any suitable material, such as metal plate or grating or a suitable plastic, such as a polymeric material.

The first platform 1 can be configured to move bi-directionally along an axis 15. In the depicted embodiment, several wheels are attached to the bottom surface 5 of the first platform 1 which permit the first platform 1 (and items connected to or resting on it) to move along two rails 140 that are disposed in parallel with the axis 15. Illustrative such rails 140 can be installed on a metal structure built to hold the first platform 1 (and items connected to or resting on it) or the rails 140 may be installed in or on a concrete foundation, as depicted.

It is preferable to equip the first platform 1 so that it can be moved automatically. Such automatic movement can be provided by attaching a track 130 to the bottom surface 5 of the first platform 1. Such track 130 can include a plurality of apertures disposed along a common longitudinal axis within the track 130, where such apertures are configured to receive teeth provided by a gear 135. Such gear 135 can be attached to a reversible motor (not shown) that, by turning the gear 135 in the track 130, will move the first platform 1 (and items connected to or resting on it) in both directions along axis 15. If desirable, more than one track 130 and gear 135 combination may be used to power the movement of the first platform 1, with such other tracks 130 and gears 135 connected to either the same motor or additional motors, as appropriate. Moreover, any other suitable equipment or techniques may be used to move the first platform 1. Such suitable equipment can include, for example, the attachment of a chain to the bottom or top surface 5, 3 of the first platform 1, with each end of the chain being associated with a motor disposed at the respective crosswise sides 11, 13 of the first platform 1 so as to permit each motor to pull the chain in the direction of the motor thereby providing the desired movement of the first platform 1. Additionally, the first platform 1 may be otherwise moved, such as by having an operator push or pull the platform by either gripping the first platform 1 or something attached to the first platform (such as the steel supporting the second platform 30) so that the first platform 1 may be moved using a device (or person) located above the top surface of the manufacturing floor 45. In an alternative embodiment, a reversible motor can be mounted to the bottom surface 5 of the first platform 1. The shaft of the reversible motor can then be indirectly connected to one of the wheels 150, such as by using a right-angle gear box and a Lovejoy™ flex coupling, so as to make the wheel 150 a drive wheel which can then power the bi-directional movement of the platform 1 and, as appropriate, structure 180.

Illustratively, one of the wheels 150 located in the center of the first or second longitudinal side 7, 9 of the first platform 1 is used as the drive wheel. In these embodiments, the motor can be powered as discussed herein, such as by plugging it into an outlet 250A-D.

The first platform 1 includes a first form base 17 and a second form base 19, each of which resides on the top surface 3 of the first platform 1. The first form base 17 and the second form base 19 are each releasably secured to the first platform 1 so as to permit the interchange of form bases during the manufacturing process, such as to accommodate different form types and sizes, as discussed herein.

The first and second form bases 17, 19 can be releasably secured to the first platform 1 using any suitable means, such as by threading bolts into nuts that are affixed to the bottom surface 5 of the first platform 1 or by using quick release means, such as pneumatic or manual clamps and the like. In certain embodiments, the first and second form bases 17, 19 are releasably secured to the first platform 1 by disposing cylindrical sleeves (not shown) that are mounted on the first and second form bases 17, 19 over two or more pins (not shown) that extend vertically upward from and perpendicular to the top surface 3 of the first platform 1. Illustratively, each sleeve has an inner diameter that permits it to slide over its respective pin in a relatively snug fashion. Each pin can have a hole located near the upward most portion of the pin for receiving a cotter type or similar locking means that secures the form bases 17, 19 in place once the sleeves are received over the pins. Preferably, form bases 17, 19 of different sizes (such as for different mold types) have the same sleeve pattern thereby permitting sleeves on different sized form bases 17, 19 to fit over the same pin configuration in order to streamline operations. The pins can be removed, however, such as to accommodate form bases 17, 19 that do not have sleeves. To accommodate these embodiments, the pins can be secured by mounting them on a common structure, such as a piece of flat stock. Holes can then be placed in the first platform 1 for receiving the pins. The flat stock (with the pins) is then placed adjacent to the bottom surface 5 of the first platform 1 with the pins extending through the top surface 3 of the first platform in an upward direction. The flat stock assembly can be secured to the first platform with a bolt that extends through the first platform 1 and flat stock so as to permit a nut to be secured to the end of the bolt. Illustratively, the head of the bolt can comprise a round head and square neck so as to interlock the bolt head to the first platform 1 while providing a smooth bolt head surface above the first platform 1. In embodiments having two pins, the pins can be disposed 180 degrees from one another along a single piece of flat stock. In additional embodiments, the pins need not have a circular cross-section, but can occupy any suitable cross-section, such as square, rectangular, or trapezoidal. Additionally, the form bases 17, 19 can be retained on the pins using any suitable means, such as a thread/net combination or clips, however, cotter keys (and similar devices) are preferable because they will break before damaging equipment in the event an operator pulls a form 25, 27 from the form base 17, 19 prior to removing the cotter key.

The first and second form bases 17, 19 can be configured to releasably receive a form used in the manufacture of concrete articles. As depicted in FIGS. 1-2, the first form base 17 is configured to releasably receive a form 25 that is configured to produce two concrete pipe sections, and the second form base is configured to releasably receive a form 27 that is configured to produce a single concrete pipe section. Such forms 25, 27 can be releasably secured to the respective form bases 17, 19 using any suitable means, such as bolts or the like, but are preferably connected using clamps that are moveable between a secured and unsecured position using air pressure.

The first and second form bases 17, 19 that are depicted in FIGS. 1 and 2 occupy a generally square shape, each having a center point 21, 23 defined by the intersection of diagonal lines extending between each of the opposite corners of each square. Although the depicted form bases 17, 19 are depicted in the shape of a square, illustrative form bases of the invention 17, 19 can occupy any suitable shape as is appropriate for the type of form 25, 27 being used, and can be circular, ovular, trapezoidal, and the like.

As illustrated in FIGS. 1-2 the first form base 17 is located adjacent to the second form base 19 in a configuration where the center point 21 of the first form base 17 and the center point 23 of the second form base 19 are located an equal distance from the first longitudinal side 7 of the first platform 1, so as to axially align the center points 21, 23 with one another. Moreover, the first and second form bases can be located to provide a suitable distance between the form bases to implement the process of the invention. Illustrative such suitable distances, include locating the center points 21, 23 at least 4 feet from one another, with more preference given to distances of 5, 6, 7, 7.8, 8, and 9 feet from one another.

The embodiment depicted in FIGS. 1-2 also includes a second platform 30 (partially depicted in FIG. 1) having a top surface 32, a bottom surface 34, a first longitudinal side 31, a second longitudinal side 33, a first crosswise side 35, and a second crosswise side 37. As depicted, the bottom surface 34 of the second platform 30 (and therefore the top surface 34 of the second platform 30) is located at an elevation slightly higher than the top surface of the manufacturing floor 45. This elevation permits the second platform 30 to extend out over the top surface of the manufacturing floor 45 so as to eliminate any gaps between the longitudinal pit walls 43 and the first and second longitudinal sides 31, 33 of the second platform 30. Additionally, the elevation of the bottom surface 34 of the second platform 30 allows the second platform 30 to slide over the manufacturing floor while moving in conjunction with the first platform 1 as discussed below.

In the embodiment of FIGS. 1-2, the second platform 30 is configured to move bi-directionally along an axis 15 in conjunction with the first platform 1. The second platform 30 is supported by a structure 180 that also supports the first platform 1. The structure 180 can include any suitable material, such as steel, and can be configured in a box-like manner such as to provide a basis for supporting the first and second platforms 1, 30. Given that the first and second platforms 1, 30 are supported by the same structure 180, they will move together when the gear 135 is activated to move the track 130, which can also be attached to the support 180 as an alternative to attachment to the bottom surface 5 of the first platform 1.

Figure 3:
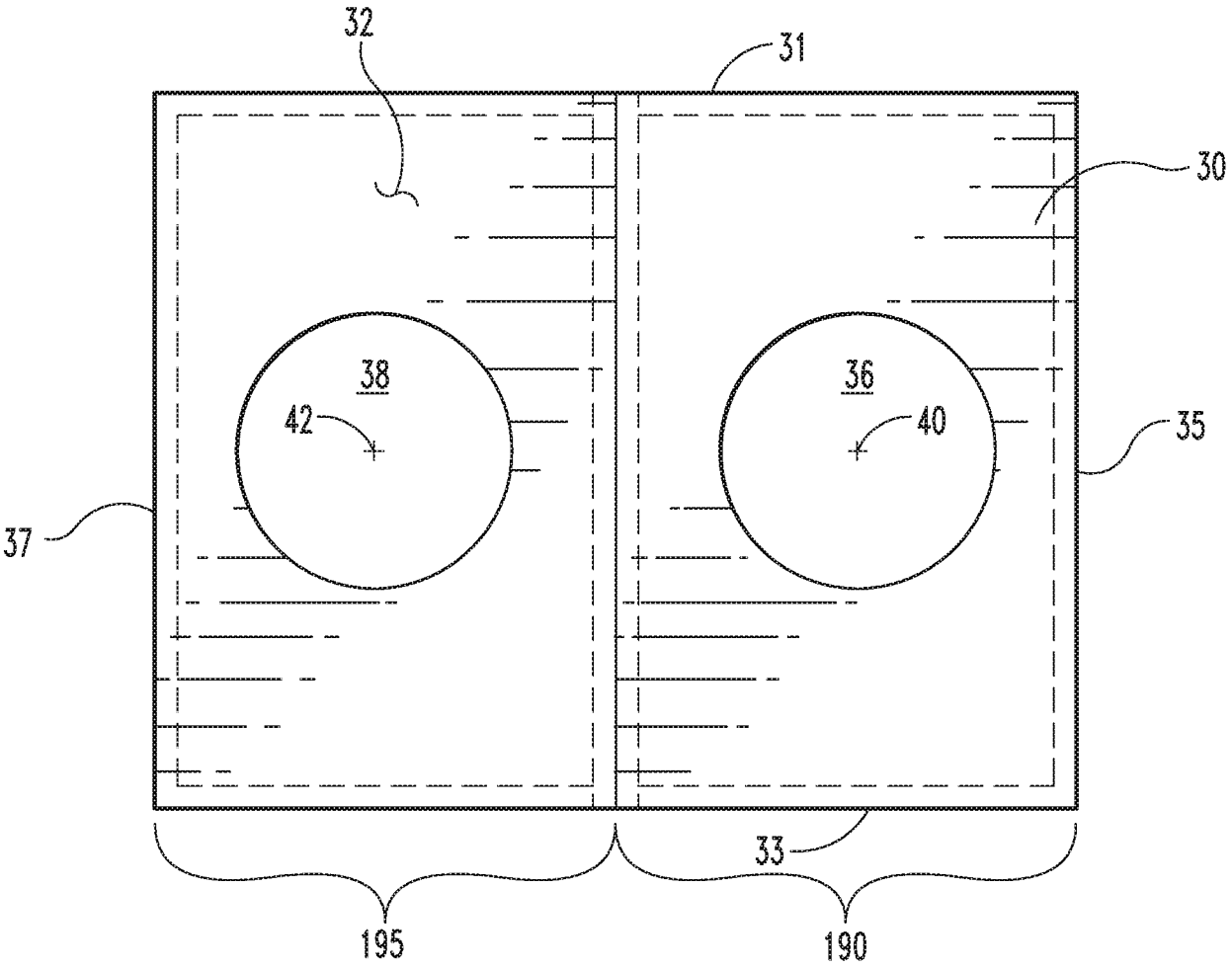
FIG. 3 provides a top plan view of an aspect of the illustrative embodiment depicted in FIG. 1.

Like the first platform 1, the second platform can be made of any suitable materials, such as steel plate, steel grating, a polymeric material or the like. As depicted in FIG. 3, the second platform can include two pieces of material that can be readily removed from the support 180. The removal of these pieces facilitates the removal of the first and second form bases 17, 19 so that they can be interchanged with other form bases of varying sizes, as discussed herein. The second platform 30 also includes a first hole 36 and a second hole 38, each of which can be circular in nature, with an understanding that any shape can be used with the invention, including square, rectangular, trapezoidal, and the like. The first hole 36 has a center point 40 and the second hole 38 has a center point 42, each occupying the center point of the hole's geometry. The center point 40 of the first hole 36 generally coincides with the center point 21 of the first form base 17. The center point of the second hole 38 generally coincides with the center point of 23 of the second form base 19. The coincidence of the center points will accommodate placement of the form cores 50A, 50B, 52, which are releasably secured to the first and second form bases 17, 19.

As depicted in FIGS. 1-2 the first form base 17 includes a double form core 50A, 50B, and the second form base 19 includes a single form core 52. The double form core 50A, 50B includes two cylindrical structures that extend in an upward direction with the outer walls of the cylindrical structures being generally perpendicular to the top surface 3 of the first platform. The single form core 52 extends upwardly in likewise fashion to the double form cores 50A, 50B. Each of the three cylindrical form core structures terminate roughly 3 feet above the top surface 32 of the second platform 30, but in other embodiments may terminate at any distance at or above the top surface 32 of the second platform 30. The form cores 50A, 50B, 52 serve as the inner part of a circular concrete pipe form, and create the inner exterior shape of the concrete pipe. The first and second forms 25, 27 form the outer exterior shape of the pipe. The form cores can be varied so as to make a variety of concrete articles, such as ovular pipe, elliptical pipe, arch pipe, square pipe, rectangular pipe, catch basins, manholes, square box culverts, rectangular box culverts, catch basins, circular junction boxes, square junction boxes, and lined versions of the foregoing (such as lined with polypropylene, polyethylene, polytetrafluoroethylene (PTFE), polyvinylidene fluoride (PVDF), PVDF Kynar, polyvinylchloride (PVC) and the like. Finally, the diameter of the form cores 50A, 50B, 52 can vary to manufacture different sized pipe. In similar fashion, the first and second pieces 190, 195 of the second platform 30 can be interchanged during manufacturing, such as to replace one or the other pieces 190, 195 with another piece having a similar exterior dimension, but a different hole 36, 38 size or shape so as to accommodate form cores of varying sizes or forms of varying sizes (such as where form cores are not used).

Returning to FIGS. 1-2, the illustrated embodiment also includes a ship's ladder 160 to facilitate access into the pit 200. Also depicted are a first crane 60 and a second crane 62, each of which can illustratively be a Gorbel brand 4 ton jib crane. The first and second cranes 60, 62 each have mobile booms that are configured to turn circularly around the respective first and second bases 61, 62 of the first and second crane 60, 62. A first ballast 65 is attached to the boom of the first crane 60, and a second ballast 67 is attached to the boom of the second crane 63 such that the first and second cranes 60, 62 are configured to deliver ballast above the first and second form cores 50A, 50B, 52 whereby the ballast can compress concrete in the space between the form 25, 27 and the form cores 50A, 50B, 52 during fabrication of concrete articles. Each ballast can be made of concrete cast into a cylindrical form and that weighs up to 8,000 lbs, but in other embodiments the ballast can be made of any suitable material, such as steel and have any suitable weight, such as 2,000 lbs to 8,000 lbs, and occupy any suitable geometric configuration, cuboid, etc.

The embodiment depicted in FIGS. 1-2 also includes a concrete mixer 70, such as a Del Zotto brand wet or dry cast mixer, located in between the first crane 60 and the second crane 62. The concrete mixer includes reservoirs 78, 80 for the temporary storage of rock and sand which are mixed with water to form concrete for use in the invention. Such rock and sand can be placed in their respective reservoirs 78, 80 using augers 84, that respectively carry the rock and sand to the concrete mixer 70 from rock and sand storage bins 82, 86.

An auger 72 having inlet 74 and outlet 76 can be used to carry mixed concrete from the concrete mixer 70 to a location above the first and second platforms 1, 30. The inlet of the auger can be attached to the concrete mixer 70 or may be located proximate to the concrete mixer 70, such as when the inlet 74 resides beneath the concrete mixer's 70 outlet. The auger 72 includes a motor (not shown) that powers the blade (not shown) of the auger 72. The power to the auger's 72 motor can be controlled by a controller, as discussed herein, that can also control the concrete mixer 70 and other devices as discussed in more detail below.

Figure 4:
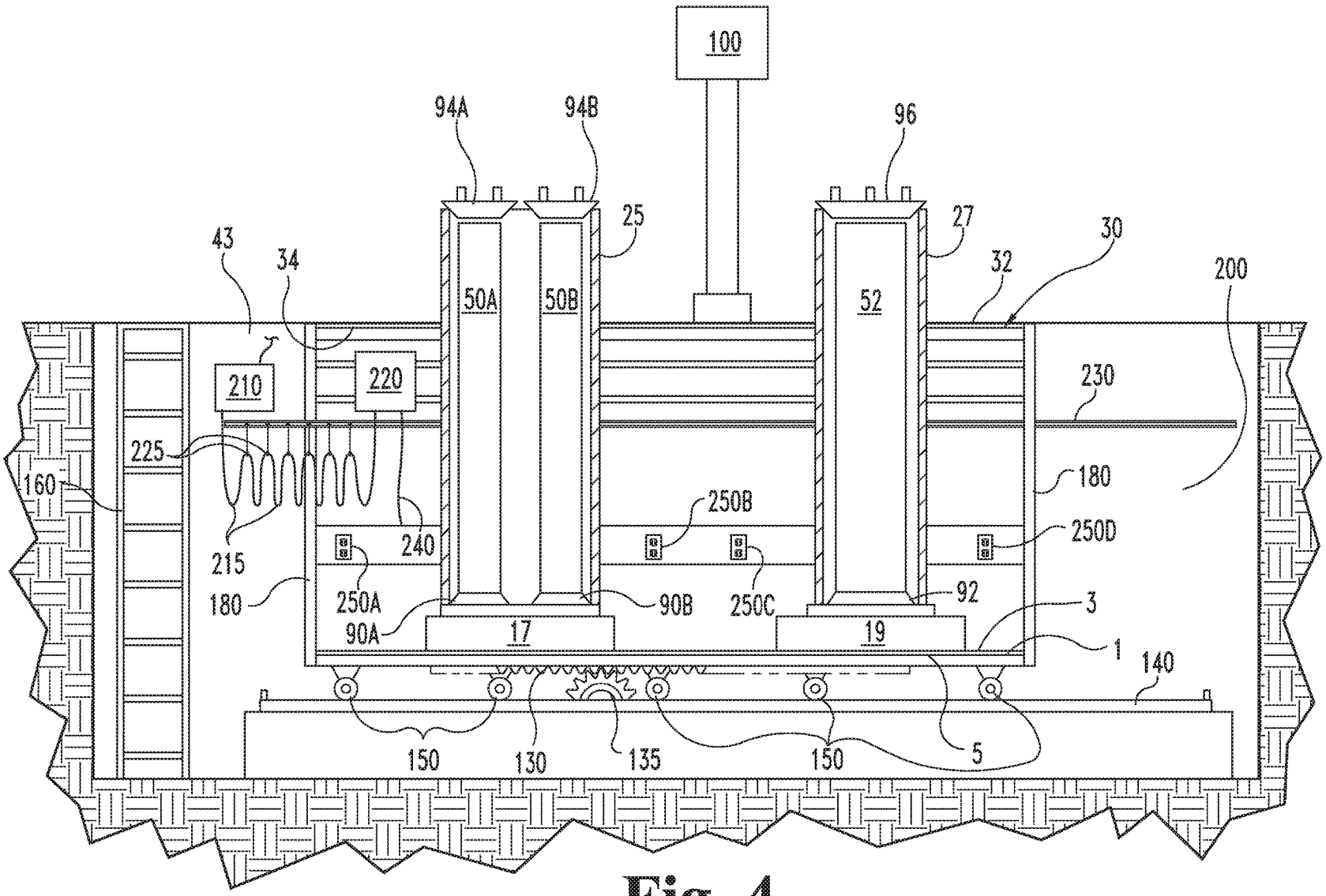
FIG. 4 provides a partial back elevation view of the illustrative embodiment depicted in FIG. 1.

FIG. 4 provides a partial back elevation view of the illustrative embodiment depicted in FIGS. 1-2. Power can be provided to the structure 180 by first running suitable wire to a first control box 210 that can be mounted in a fixed position in the pit 200, such as on a longitudinal wall 43 of the pit 210. Power can then be provided to the structure 180 by connecting wire 215 to a second control box 220 that is mounted on the structure 180. Given that the structure 180 is moveable, wire 215 is looped between the first control box 210 and the second control box 220. The looped wire 215 can hang vertically from a wire track 230 that includes a channel that faces downward toward the top surface 3 of the first platform 1. Devices 225 can have one end that is slidably received into the wire track 230 and another end that attaches to the wire 215 so as to permit the wire devices 225 to slide within the track as the structure 180 is moved, thereby unfolding and folding the loops in the wire 215 as the structure 180 is moved between positions. Power outlets 250A-250D can be mounted on the structure using any suitable means and can be provided power from the second control box 220 through wire 240.

The second control box 220 can also include one or more controllers for controlling different equipment used in the manufacture of concrete articles. For example, control panel 100 can be connected to the second control box using any suitable means. Illustratively, control panel (and its pedestal) sits on the top surface 32 of the second platform 30 and can be readily moved about the second platform 30 or onto the top surface of the manufacturing floor 45 by an operator. Such flexible movement can be permitted by connecting the control panel 100 to the second control box 220 with a long cable. Additionally, the controller (or controllers) in the second control box 220 can be connected with the controller (or controllers) on the concrete mixer 70 using suitable wiring and configuration. An illustrative configuration would be similar to that used to connect power wire 215 between the first and second control boxes 210, 220. The control cable (not shown) would be connected between the first and second control boxes 210, 220, like wire 215. The control cable would then be run from the first control box 210 to the controller located in the concrete mixer (not shown) through conduit or similar means. This configuration allows a user to control aspects included on the structure 180 as well as the concrete mixer 70 and auger 72 from the control panel 100 (given that the concrete mixer 70 controller typically controls the auger 72 and aspects of the concrete mixer 70).

Figure 5:
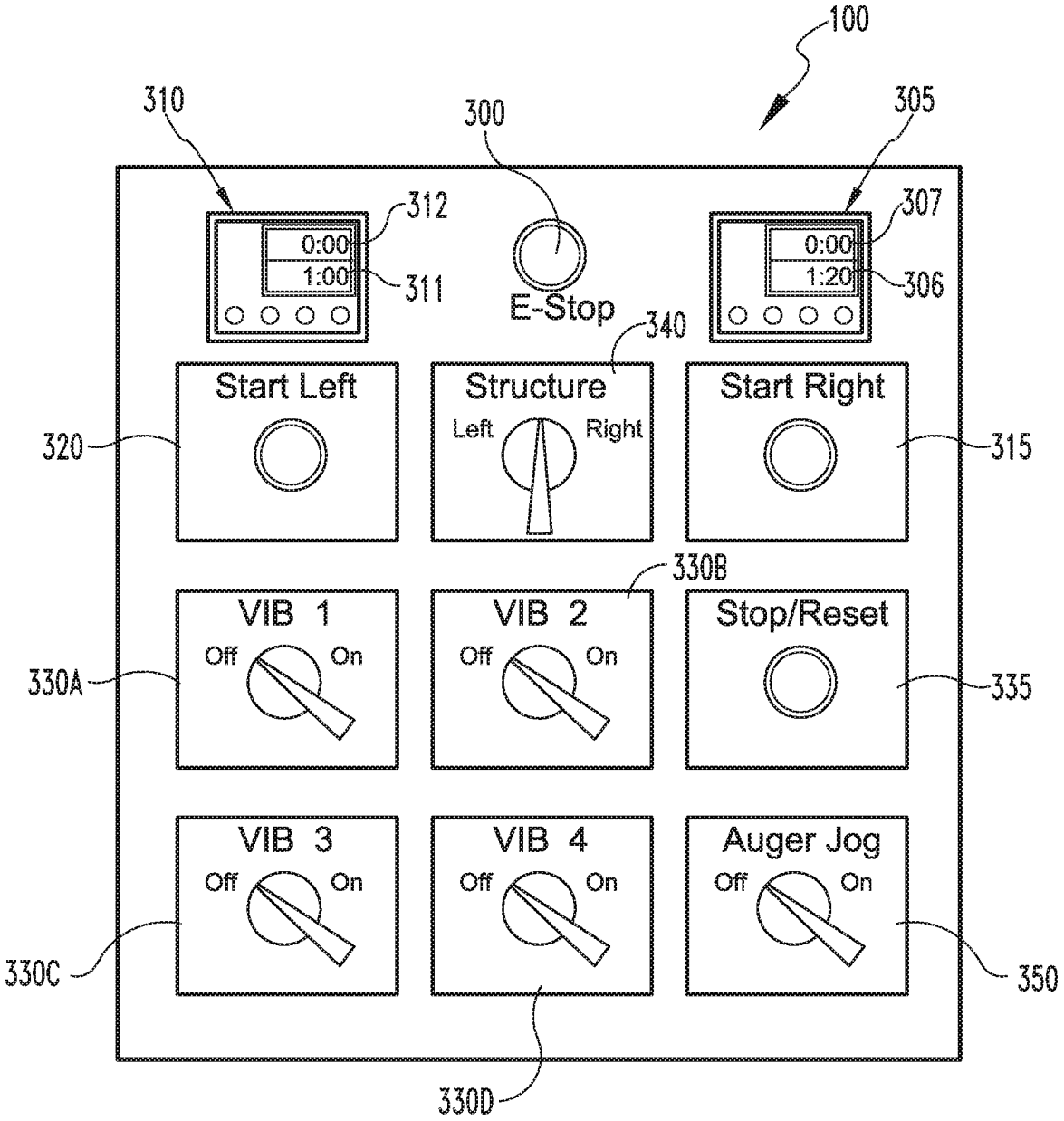
FIG. 5 provides an upper-back plan view of a control panel that can be used to operate the illustrative embodiment depicted in FIG. 1.

FIG. 5 depicts an illustrative control panel 100 of the invention that can control equipment located on structure 180, as well as the concrete mixer 70 and auger 72. The illustrative control panel 100 includes controls that permit the operation of the processes described herein. The control panel 100 is labeled from the perspective of an operator who is standing near the second longitudinal side 33 of the second platform 30 and looking toward the concrete mixer 70. As evident, the control panel 100 includes controls to permit the process to be conducted using two forms 25, 27, but can be modified to accommodate a process having as few a one form or as many forms as desirable, such as four, for example.

The control panel includes a first timer control 305 and a second timer control 310. Each timer control 305, 310 permits a user to establish a set point, which is the amount of time the concrete will pour into the form after the corresponding start button 315, 320 is depressed. The set points can be adjusted by a user and are displayed as first and second set point readings 306, 311. The timer set point readings 306, 311 are adjusted based on the volume of concrete that is necessary to fill area between the form and form core that is being used during manufacturing. As is understood, forms requiring more concrete will have larger set point readings to accommodate a larger concrete pour. The first and second timer controls 305, 310 also display the time that has elapsed since the respective start button 315, 320 has been depressed to permit a user to understand how much time is remaining for the pour. When the programmed set point is hit, the timer control 305, 310 turns the concrete mixer 70 and auger 72 off by shutting off power to each device.

Once a start button 315, 320 is depressed, the timer 307, 312 will start running as the concrete starts to pour from the auger outlet 76 (given that timer control 305, 310 has established power to the concrete mixer 70 and auger 72). As concrete fills the form, the operator can turn appropriate core vibrators on and off using the appropriate vibrator control 330A-330C. By way of illustration, a form core 50A, 50B, 52 can include an upper and lower internal vibrating mechanism. Such vibrating mechanisms can be controlled by electrical power, and can therefore be plugged into outlets 250A-250D. Each vibrator control 330A-330D can control power to an outlet 250A-250D thereby control the operation of the core vibrator that is plugged into the outlet 250A-250D. In alternative embodiments form cores 50A, 50B, 52 can include single core vibrators or can include a plurality of core vibrators, such as can be commonly or discretely powered. Additionally, in certain embodiments, the form 25, 27 can include vibrators that are mounted externally at an appropriate location (or locations) along the form's 25, 27 outer periphery. Typically, external form vibrators are used on forms for box culverts, catch basins, junction boxes, and the like. When using external form vibrators, they can be plugged into outlets 250A-D after the form 25, 27 is located on the first platform 1, and unplugged before the form is removed.

On occasion, the operator may decide she needs additional concrete in the form than was provided by the timer control's 305, 310 set point value. When this occurs, the operator can press the stop/reset button 335, which resets the timer control 305, 310, thereby permitting the user to restart the timer control 305, 310 to get more concrete into the form. Once sufficient additional concrete enters the form, the operator can depress the stop/reset button to stop the concrete mixer 70 and the auger 72. The stop/reset button can also be used to reset the timer control 305, 310 at the conclusion of a normal run, such as where the set point of the timer control 305, 310 delivered sufficient concrete into the form.

Once the form is filled, the structure 180 can be moved by manipulating the structure location switch 340 so as to position the filled form away from the auger's outlet 76 and closer to the first or second crane 60, 62, as appropriate, to press the concrete into the form using the first or second ballast 65, 67. The control panel 100 can includes an emergency stop button 300 that, when depressed, kills power to the power outlets 250A-250D, the concrete mixer 70, and the auger 72. The control panel 100 finally includes an auger jog button 350 that jogs the auger (while not adding additional concrete into the auger 72). This button is typically used to clean the concrete out of the auger after production is done for the day, and toggles power to the auger. It is understood that control panel 100 can be further automated, such as by use of automation computers, for example programmable logic controllers with graphical user interfaces and the like, if desirable. In other embodiments, the buttons and switches on the control panel 100 can be varied to accommodate other desired functionality, as appropriate.

With general reference to components described in FIGS. 1-2, and 4-5, an illustrative process for manufacturing concrete articles will be described. Overhead crane 115, which can be moved longitudinally and crosswise over the top surface of the manufacturing floor 45 (and pit 200), is used to pick up form 25 that includes lower form rings 90A, 90B, which support the concrete in the form and create any end impressions for the pipe. Illustratively, rebar may be included within form 25 to add strength to the concrete article. The overhead crane 115, controlled by an operator, then places the form 25 (optionally containing rebar) over the first form core 50A, 50B so as to create a space between the first form 25 and the first form core 50A, 50B. The structure 180 (with the first and second platforms 1, 30) is then moved such that the first form core 50A, 50B is generally located under the outlet 76 of the auger 72. Concrete is then fed from the auger outlet over the first form core 50A, 50B. Typically, an operator helps locate the concrete into the space between the first form 25 and the first form core 50A, 50B as it is being poured. After or during placement of the concrete, upper rings 94A, 94B are placed at the top of form 25 so as to create any end impressions in the pipe and to assist with the compression process described below.

While concrete is placed into the space between the first form 25 and the first form core 50A, 50B, a second form 27 having a lower form ring 92 (and optionally containing rebar) can be located over the second form core 52 with the overhead crane 115. When the space between the first form 25 and the first form core 50A, 50B is filled, the structure 180 (with first and second platforms 1, 30) is moved to locate the first form 25 by the first crane 60, and the second form core 52 underneath the auger 72 outlet 76.

The first crane is then manipulated to lower the first ballast 65 onto the upper rings 94A, 94B so as to compress the concrete located in the space between the first form 25 and first form core 50A, 50B with the first ballast 65 so as form a concrete pipe having an outer exterior shape of the first form 25 and an inner exterior shape of the first form core 50A, 50B. As with the concrete filling process, the vibrators inside the form core 50A, 50B can be used to help manipulate the concrete in the form 25 and provide smooth interior and exterior surfaces to the pipe. After compression is complete, the first crane 60 is manipulated to move the first ballast 65 from over the first form 25 so as to permit the overhead crane 115 to remove (by lifting) the first form 25 from the form core 50A, 50B to a location where the form 25, and optionally the upper rings 94A, 94B, are removed to permit the concrete pipe to cure.

While the concrete in the first form 25 is being compressed, the concrete mixer 70 and auger 72 can be turned on so as to feed concrete from the auger outlet 76 over the second form core 52. Such concrete is fed until it sufficiently fills the space between the second form 27 and second form core 52. The second form core 52 may optionally be vibrated during the form filling process.

While the second form 27 is being filled with concrete, an empty form can be placed over the first form core 50A, 50B, so that it is ready for filling when the concrete in the second form 27 is undergoing compression by resting the second ballast on the upper ring 96. This process can be continued resulting in an improved, low cost manufacturing process for concrete articles.

Figure 6:
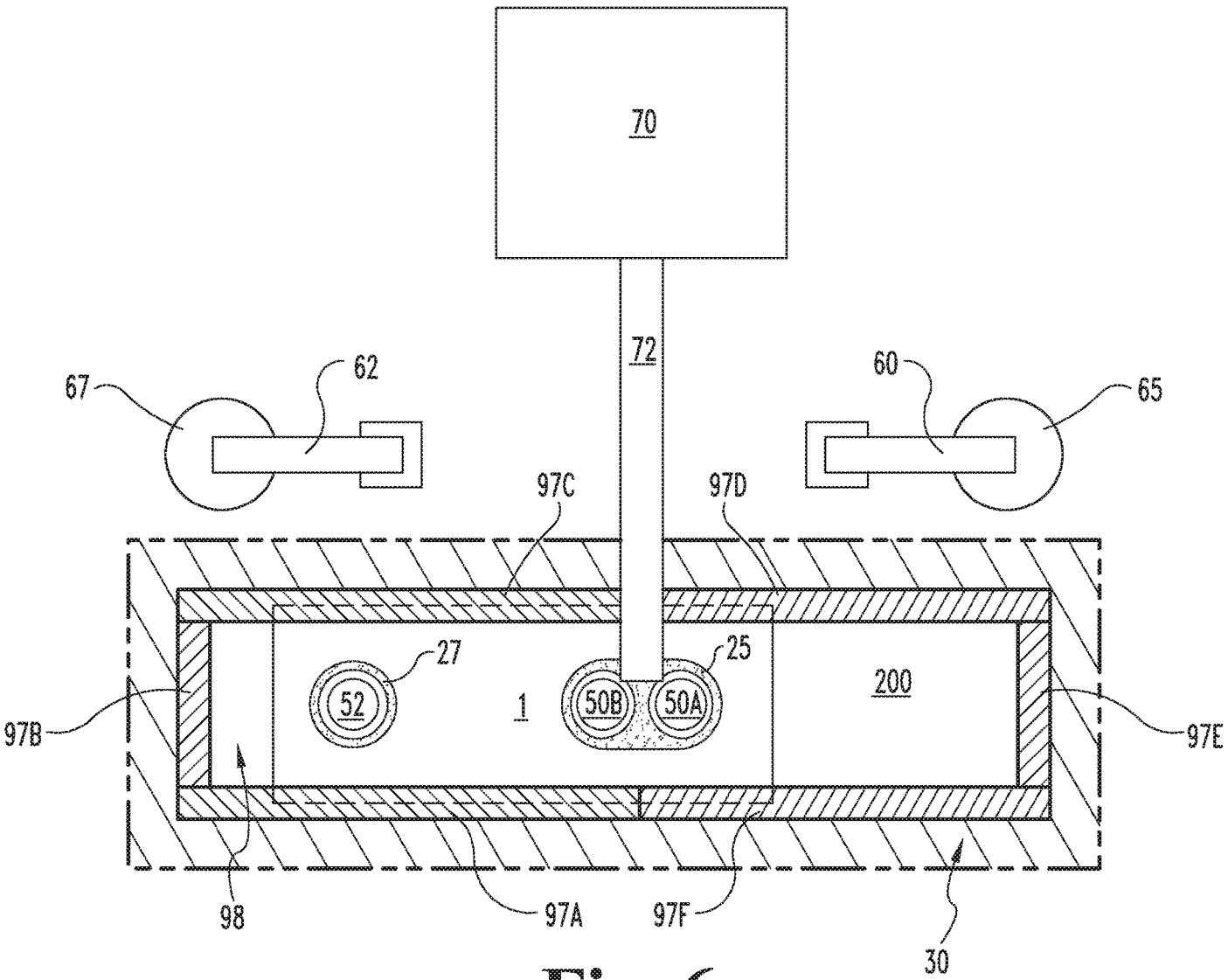
FIG. 6 provides a partial top plan view of an illustrative embodiment of the invention.

FIG. 6 shows a partial top plan view of an illustrative embodiment of the invention where the second platform 30 does not move bi-directionally with the first platform 1, but rather is stationary during movement of the first platform 1. The second platform 30 includes a rectangular opening 98 that permits the first and second form cores 50A, 50B, 52 to extend above the second platform 30 but also move in a bi-directional manner with the first platform 1. The second platform 30 can also include removable sections 97A-97F, that rest on structural support members (not shown) when in place. The removable sections 97A-97F can be removed, as appropriate to accommodate different first and second form sizes 25, 27, as well as to permit the interchange of first and second form bases 17, 19 so as to provide for the manufacturer of different types of articles, e.g. catch basis, box culverts, junction boxes, manholes, pipe (ovular, circular, arch, elliptical, square, rectangular, and the like), as well as different sizes of each type of article, e.g. 12 inch, 24 inch, 36 inch, 48 inch pipe and the like. After new form bases are in place, the removable sections 97A-97F can be replaced, as appropriate In additional embodiments, the first platform 1 may be located at any suitable elevation, including at an elevation just above the top surface of the manufacturing floor 45. This embodiment would prevent the need for a pit 200, but may require an elevated second platform 30 to accommodate workers overseeing the feed and compression steps. Such a second platform 30 could move bi-directionally with the first platform 1 or could be stationary, as described herein. Moreover, the elevation of the first platform 1 would require elevation of the auger outlet 76, as well as higher booms on the first and second cranes 60, 62. Alternatively, one or more overhead cranes 115 could be used, instead of or in conjunction with at least a first crane 60 to provide the manufacturing process of the invention. In this embodiment, the first crane 60 may be located near the center of the longitudinal wall of the pit 200.

In yet another embodiment, the structure 180 can be supported by the second platform 30. In such embodiments, the equipment necessary to bi-directionally move the structure (and the first and second platforms 1, 30) can be located above the top surface of the manufacturing facility floor 45, or alternatively, can be slightly recessed into the floor. This permits the mechanical equipment associated to move the platform to be located above the grade of the manufacturing floor.

In yet an alternative embodiment, the first platform may only provide one form base 17 or may provide for more than two form bases 17, 19. By way of example, four form bases may be provided on the first platform 1, with the third and fourth form base being located between the respective first and second form bases 17, 19 and the second longitudinal side 9 of the first platform 1. This configuration would provide for common processing at the first form base 17 and third form base (not shown) and common processing at the second form base 19 and fourth form base (not shown). Any one of the concrete mixer 70, auger 72, first crane 60, or second crane 62 could be replicated on the opposite side of the pit, or alternatively, the same equipment could be used to complete the manufacturing process, possibly with an auger outlet 76 equipped to split the concrete flow between the first and third forms and second and fourth forms, or alternatively permit successive flow of concrete to the forms, as appropriate.

Illustrative first platform dimensions can include locating the top surface 3 of the first platform 1 at a depth of 7.8 feet beneath the top surface of the manufacturing floor 45. Additionally, the first and second longitudinal sides 7, 9 can be 20 feet in length while the first and second crosswise sides 11, 13 of the first platform 1 can be 9.5 feet in length. The second platform can occupy the same or similar dimensions. Of course, any of these dimensions can be varied, as appropriate, to implement various embodiments of the invention.

Suitable concrete mixtures are known in the art and the slump of such mixtures can be varied by the concrete mixer 70 to accommodate both dry-cast and wet-cast production techniques, with preference given to the use of dry-cast concrete.

All publications cited herein are hereby incorporated by reference in their entirety as if each had been individually incorporated by reference and fully set forth.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An apparatus for the manufacture of articles made of concrete, comprising:

a first platform having a top surface and a bottom surface, wherein said first platform is configured to move bi-directionally along an axis, at least one form base, wherein said at least one form base resides on said top surface of said first platform and is releasably secured to said first platform;

wherein said at least one form base is further configured to releasably receive a form used in the manufacture of concrete articles; and a second platform having a top surface and a bottom surface, wherein said second platform is located above said first platform.

2. The apparatus of claim 1, wherein said first platform comprises a rectangular shape, and wherein said first platform further comprises first and second longitudinal sides and first and second crosswise sides.

3. The apparatus of claim 2, wherein said first and second longitudinal sides are 20 feet in length.

4. The apparatus of claim 3, wherein said first and second crosswise sides are 9.5 feet in length.

5. The apparatus of claim 1, wherein said at least one form base comprises a first form base and a second form base.

6. The apparatus of claim 5, wherein said first form base and said second form base each comprises the shape of a square, each form base further having a center point located in the center of said square.

7. The apparatus of claim 6, wherein said first form base is located adjacent to said second form base, and wherein said center point of said first form base and said center point of said second form base are located an equal distance from said first longitudinal side of said first platform.

8. The apparatus of claim 7, wherein said center point of said first form base is located 11.4 feet from said center point of said second form base.

9. An apparatus for the manufacture of articles made of concrete, comprising:

a first platform having a top surface and a bottom surface, wherein said first platform is configured to move bi-directionally along an axis between a first position and a second position, a first form base and a second form base, wherein said first form base and said second form base each reside on said top surface of said first platform; and wherein said first form base and said second form base are each configured to releasably receive a form used in the manufacture of concrete articles; and a second platform having a top surface and a bottom surface, wherein said second platform is located above said first platform.

10. The apparatus of claim 9, wherein said first form base and said second form base are each releasably secured to said first platform.

11. The apparatus of claim 9, wherein said first form base further includes a first form core.

12. The apparatus of claim 11, wherein said second form base further includes a second form core.

13. The apparatus of claim 12, wherein said first form core is configured to vibrate.

14. An apparatus for the manufacture of articles made of concrete, comprising:

a first platform having a top surface and a bottom surface, wherein said first platform is configured to move bi-directionally along an axis, a first form base, wherein said first form base resides on said top surface of said first platform;

wherein said first form base is further configured to releasably receive a first form used in the manufacture of concrete articles;

a second platform having a top surface and a bottom surface, wherein said second platform is located above said first platform; and wherein said top surface of said second platform is located at the same or higher elevation as a top surface of a floor in a manufacturing facility.

15. The apparatus of claim 14, further including a second form base, wherein said second form base resides on said top surface of said first platform.

16. The apparatus of claim 14, wherein said first form base is releasably secured to said top surface of said first platform.

17. The apparatus of claim 14, wherein said second platform is configured to move in conjunction with said first platform.

18. The apparatus of claim 14, further comprising at least one crane, said at least one crane configured to position a ballast above said first form.

* * * * *